United States Patent [19]

Van den Brink et al.

[11] Patent Number: 4,767,217

[45] Date of Patent: Aug. 30, 1988

[54] MIXER APPARATUS AND METHOD FOR SANITARY MIXING OF SOLIDS WITH OTHER SOLIDS AND/OR LIQUIDS

[75] Inventors: Gilbert J. J. Van den Brink, Cranbury, N.J.; Koos Leemker, Lelystad, Netherlands

[73] Assignee: Schugi, Lelystad, Netherlands

[21] Appl. No.: 47,747

[22] Filed: May 8, 1987

[51] Int. Cl.[4] ..... B01F 15/02; B01F 5/04

[52] U.S. Cl. ..... 366/168; 366/219

[58] Field of Search ..... 366/167, 168, 172, 173, 366/1, 2, 53, 69, 219, 138, 154, 64, 65, 155, 177, 251, 279, 348, 349; 99/348

[56] References Cited

U.S. PATENT DOCUMENTS

| | | | |
|---|---|---|---|
| 3,595,530 | 7/1971 | Hubers | 366/332 |
| 3,820,726 | 6/1974 | Takechi | 366/219 |
| 3,887,166 | 6/1975 | Ginneken | 366/168 |
| 4,112,517 | 9/1978 | Giombini | 366/168 |
| 4,453,832 | 6/1984 | Schumacher | 366/167 |

*Primary Examiner*—Robert W. Jenkins

*Attorney, Agent, or Firm*—Roberts, Spiecens & Cohen

[57] ABSTRACT

A method and apparatus for mixing two substances under sanitary conditions in which a solid particulate substance is introduced into an inlet chamber with radial and downward velocity components and is mixed with a second substance in a mixing chamber below the inlet chamber by rotating a vertical shaft with mixing blades thereon in the mixing chamber. The mixing chamber is formed with a flexible wall which is deformed as the shaft rotates to prevent accumulation of mixed product on the wall. The vertical shaft is rotatably supported by bearings outside the inlet and mixing chambers so as not to contaminate the substances being mixed so that mixing takes place under sanitary conditions and the mixture of substances is discharged from below the mixing chamber. When the second substance is a liquid, the mixed product is an agglomeration of particles, a paste, a slurry or a solution. The bearings are mounted in a bearing assembly outside the inlet and mixing chambers and a motor is connected to the bearing assembly so as to be removed with it, as a unit, together with the vertical shaft and blades and a portion of the inlet chamber.

34 Claims, 4 Drawing Sheets

MIXER APPARATUS AND METHOD FOR SANITARY MIXING OF SOLIDS WITH OTHER SOLIDS AND/OR LIQUIDS

FIELD OF THE INVENTION

The invention relates to a mixer for mixing solids with other solids and/or liquids under sanitary conditions and to the method of such mixing.

BACKGROUND

There are many circumstances under which it is necessary to effect mixing of solids with liquids and/or solids under absolutely sanitary conditions. These include the production of food products, pharmaceutical products, mineral products and chemical products of high purity.

The products of the mixing can be in the form of mixed powders, wet granules, pastes or slurries.

In the production of the mixed products, it is essential that the products do not come into contact with contaminants, such as bearing lubricants. It is also essential that the mixing apparatus be easily cleaned to prevent contamination of the product with any built-up product which remains within the mixing apparatus. The apparatus should also be of a construction to preclude such build-up of product.

The mixing apparatus and method of the invention is directed to the mixing of solids with other solids and/or liquids and is distinguished from liquid-liquid mixers. In this regard, the mixing of solids with other solids and/or liquids is effected at high speeds of rotation, between 1000 and 4000 rpm, of a mixing shaft in a mixing chamber. This produces high shear forces and is contrasted with a liquid-liquid mixer in which the speed of rotation is much lower and relatively low shear forces are developed. Furthermore, because of vessel size, the shaft in the liquid-liquid mixers is able to deflect or tilt considerably without any adverse effect. In contrast, the mixing of solids with other solids and/or liquids is effected in a mixing chamber which has close tolerance with the shaft and permissable deflection or tilt of the shaft is minimal. Rotating shafts have a critical speed at which the shaft undergoes maximum deflection or tilt. The critical speed is a function of a number of factors, such as rigidity of the shaft, diameter and length of the shaft, type of support of the shaft etc. When the shaft of a mixer goes from rest to its operating speed during start-up and in reverse during stoppage, the shaft passes through its critical speed. In liquid-liquid mixers, this is of little significance and the critical speed may even be within the operating speed of the mixing shaft. In mixers of solids with other solids and/or liquids, the critical speed of the mixing shaft and the maximum deflection become important factors.

U.S. Pat. No. 3,887,166 discloses a mixer for mixing solids with liquids in which the wall of the mixing chamber is made of flexible material and the wall is constantly deformed during mixing to prevent build-up of deposits on the wall.

Although this mixer has proved to be of substantial value in continuously producing products under relatively controlled conditions, there is still a need for a mixer for producing highly pure products which meet stringent sanitary requirements. Namely, in this mixer unavoidable remnants of product are left behind in dead corners, in cracks and in crevices, which will contaminate the next load of product. Moreover, in the food, pharmaceutical and allied industries, there is the additional problem of bacteria growth at places which contain remnants of product. These two problems cannot sufficiently be solved by cleaning the mixer without disassembly.

Moreover, the conventional mixer is intended to operate continuously. This has the advantage over batch mixers in that it can produce large output more economically with less labor and the products are more uniform. However, if frequent changes are necessary for different product formulations, different dyes, different liquid binders and the like, the existing continuous mixer is disadvantageous as compared to batch mixers as the latter can be cleaned more quickly. Batch mixers are usually trough-shaped ribbon blenders or paddle mixers, conical mixers, fluid bed granulators, and the like. These are all easily accessible and cleanable. The more troublesome cleanability of the conventional mixers as disclosed in U.S. Pat. No. 3,887,166 causes extra down time between changeover of products.

In the food industry, the known mixers are used to transform powdery products into agglomerated products in order to instantize these products. Powdery food products, such as a cake or pudding mix, a sauce mix, etc. have a tendency to float on top of the liquids which are added to them, while subsequent stirring often leads to the forming of lumps. After stirring vigorously for a while, the total product, including some or most of the lumps, will disperse in the liquid (usually water or milk). In contrast, agglomerated products usually have good wettability, sinkability and dispersion speed in the liquids in which they have to be reconstituted. These characteristics make the agglomerated products instant.

In the pharmaceutical industry, the known mixers are used to transform powdered pharmaceutical compounds into free flowing masses prior to being fed into fast operating tableting machines. Powdery compounds have poor flow properties and cannot be fed quickly and evenly into the small molds of a tableting machine which compresses the product into a tablet. The increase in speed of current tableting machines necessitates even greater free flowing properties of the pharmaceutical compounds. Moreover, agglomerated products have better compressibility characteristics than powdery products.

In the chemical industry, special alloys in powdery form have to be agglomerated in order to end up with a free-flowing granular product which fills the molds quickly and completely in which special parts, such as tools, are fabricated by sintering. No contaminants should be present in the sintering stage.

In the case of pesticides, one plant should be able to produce, for example, broad-leaf and narrow-leaf herbicides. Obviously, cross contamination would create a herbicide which would destroy everything. Since there are formulations where only a few grams per acre of active matter are needed to obtain the desired effect, cross-contamination must be avoided.

The ceramic industry has applications where frequent color changes are necessary, for example, when producing all types of mosaic tiles. To ensure perfect color consistency of all batches of tiles, no matter when manufactured, it is imperative that there be no cross-contamination of dyes.

The above represent only a few of the multitude of applications where easy-cleaning and thorough cleaning of the agglomerator is of utmost importance.

In general, in order to effect mixing or agglomeration, the following conditions must be maintained.

No metal to metal connections without intermediate packing.

No cracks or dead corners.

Internal radii in corners.

Welded connections instead of bolted ones.

Easy assembly and disassembly for manual cleaning.

SUMMARY OF THE INVENTION

An object of the invention is to provide a mixer in which solids can be mixed with solids and/or liquids under sanitary conditions suitable for producing food products, pharmaceuticals, minerals, and chemical products of high purity.

A further object of the invention is to provide such a mixer which is so constructed to prevent build-up of product therein.

Another object of the invention is to provide such a mixer which is easily and rapidly dismounted to permit replacement of parts and cleaning of the interior of the mixer.

In order to satisfy the above and further objects of the invention, there is contemplated a mixer for effecting mixing under sanitary conditions comprising a mixing chamber, a rotatable mixing shaft in said mixing chamber, said shaft extending vertically, blade means on said mixing shaft for mixing a product in the mixing chamber, an inlet chamber secured to said mixing chamber and including a first inlet means for introducing solid particles into the inlet chamber, and a second inlet means for combining a second substance with the solid particles. The mixing shaft projects vertically above and outside said inlet chamber and a bearing assembly is secured above and outside said inlet chamber to rotatably support the mixing shaft. The bearing assembly includes first and second bearings located one above the other each rotatably supporting said shaft. The shaft extends downwardly in suspended manner from said bearing assembly and freely projects without any other support into the inlet and mixing chambers. A seal means is located outside said inlet chamber for sealing said shaft and said inlet chamber. The mixing chamber comprises a tubular wall of flexible material surrounding said blade means and the wall is deformed as said mixing shaft rotates to prevent accumulation of mixed material on said wall. The wall has a bottom outlet for discharge of the mixed material.

According to one preferred embodiment, the second substance is a liquid and the injector means injects the liquid onto the powder substance to wet the particles.

A feature of the invention is that the inlet chamber is made in two parts constituted by separable upper and lower portions, the lower portion being secured to the mixing chamber and containing the injector means, while the upper portion incorporates the inlet means for the solid particles.

A further feature of the invention is that the bearing assembly, the mixing shaft and the upper portion of the inlet chamber can be removed as a unit to provide access to the interior of the mixing chamber and/or to replace the mixing shaft and/or the bearing assembly.

Another object of the invention is to provide a method for mixing solids with other solids and/or liquids under sanitary conditions and in accordance with the invention, the method comprises supplying a solid, particulate substance into an inlet chamber with radial and downward velocity components, mixing a second substance, such as a liquid, for example, water, a slurry, a paste, solution, etc. with the particulate substance in a mixing chamber below the inlet chamber by rotating a vertical shaft with mixing blades thereon in said mixing chamber, deforming the mixing chamber as the shaft rotates to prevent accumulation of mixed products in the mixing chamber, rotatably supporting the vertical shaft by bearings outside the inlet and mixing chambers so as not to contaminate the mixture whereby sanitary mixing takes place and discharging the mixture from below the mixing chamber.

DETAILED DESCRIPTION OF A PREFERRED EMBODIMENT

Figure 1A:
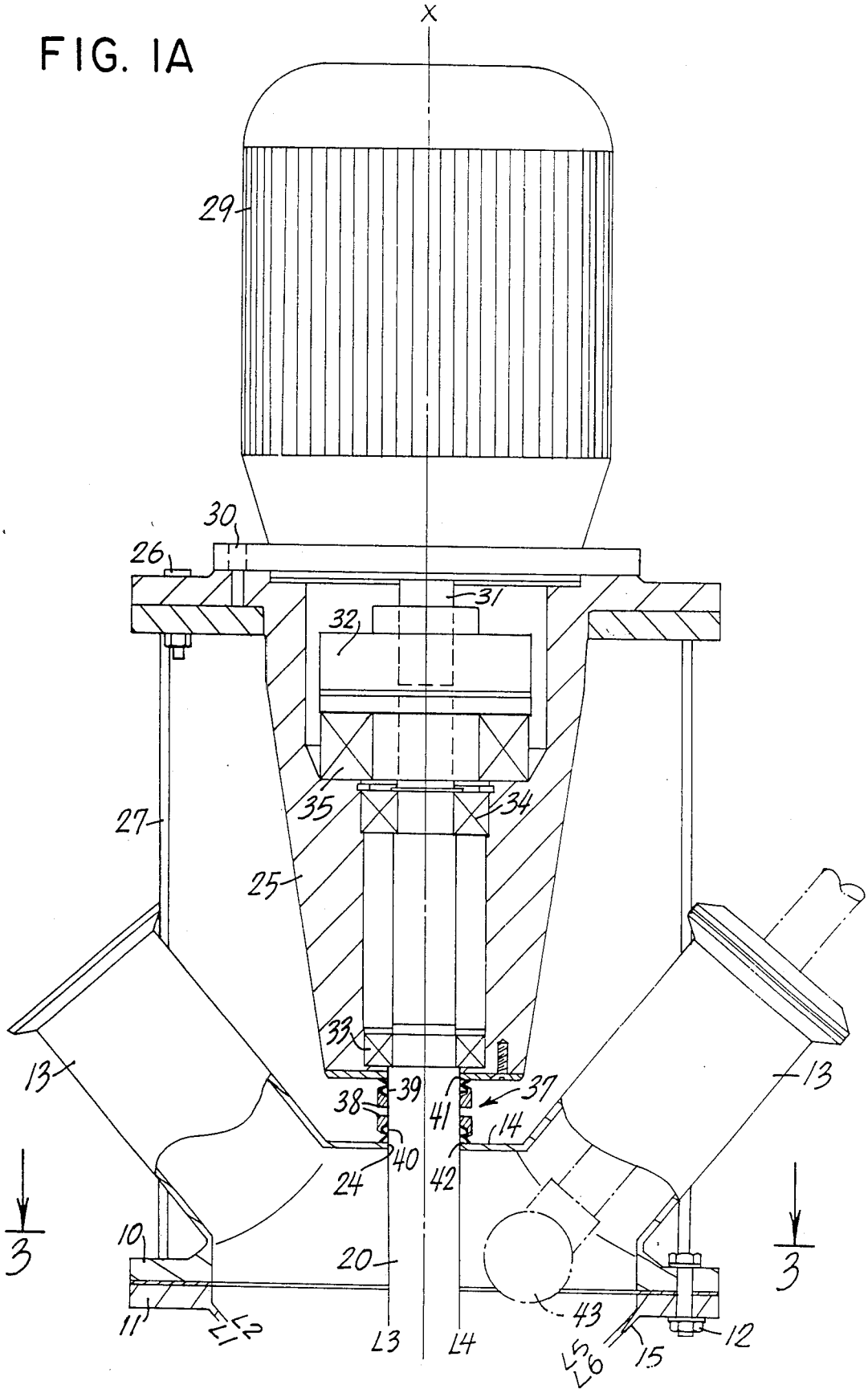
FIG. 1A is a diagrammatic elevational view, partly broken away in section, of the upper portion of a mixer according to the invention.
Figure 1B:
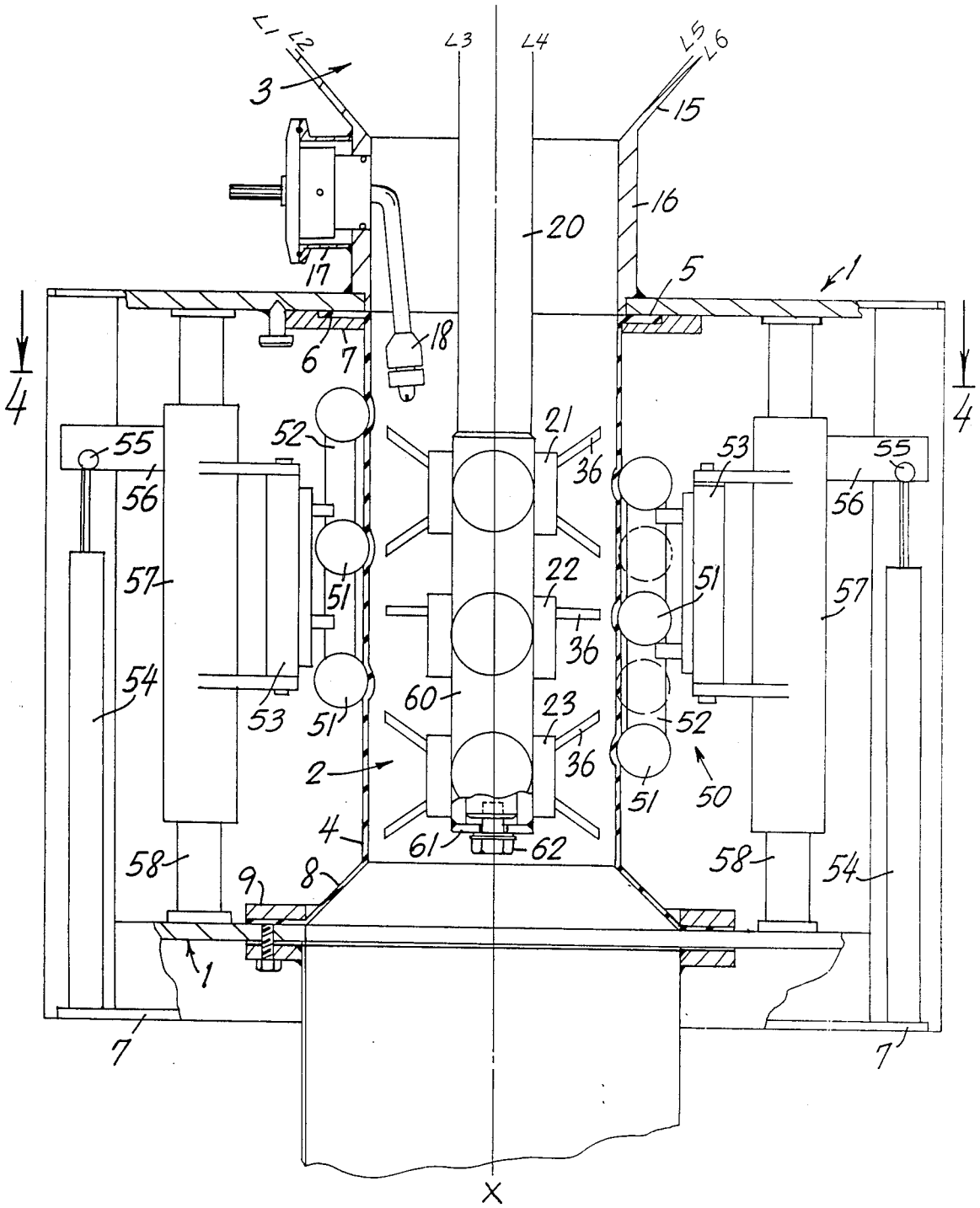
FIG. 1B shows the lower portion of the mixer, the reference characters $L_1$–$L_6$ in FIGS. 1A and 1B showing the connection points of the elements of the Figures.
Figure 2:
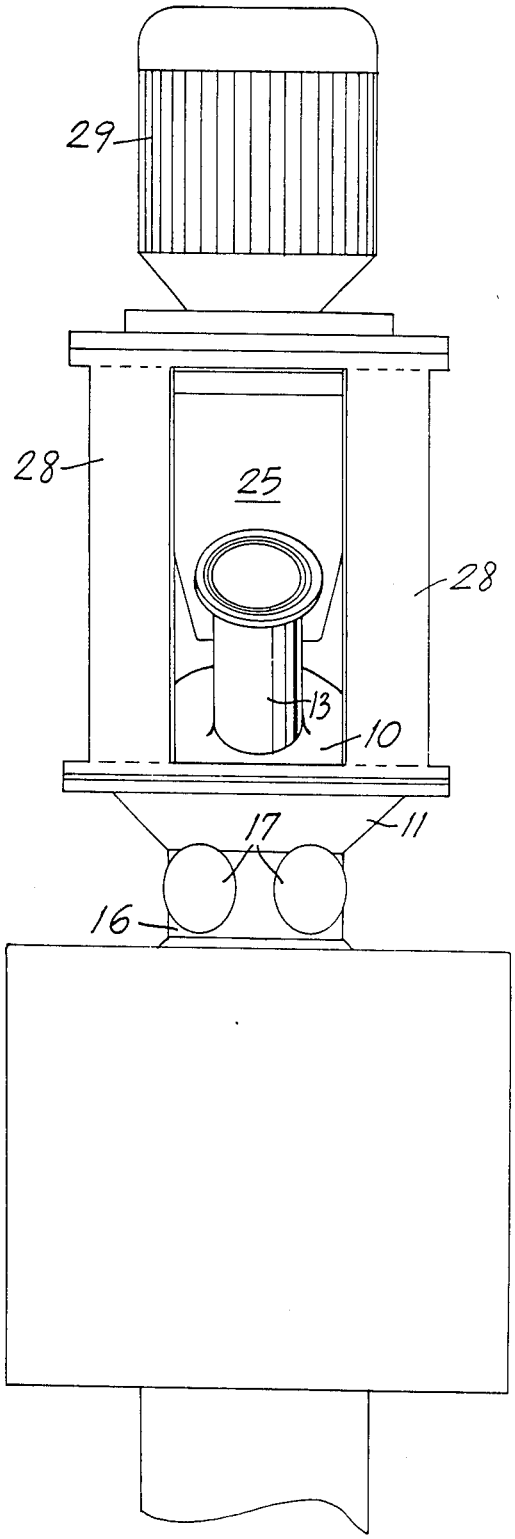
FIG. 2 is an elevational view taken at 90° from the view in FIGS. 1A and 1B showing the entire mixer on a smaller scale.
Figure 3:
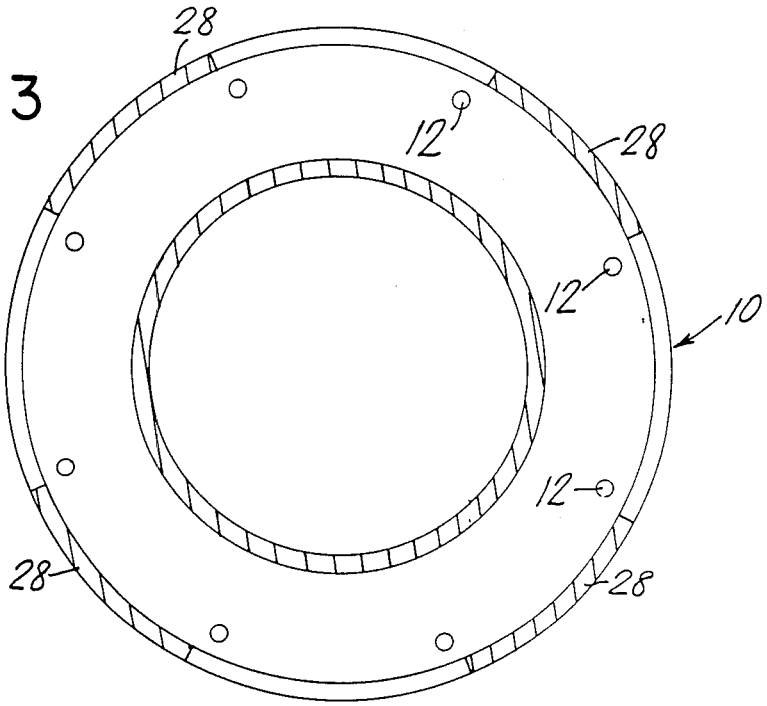
FIG. 3 is a sectional view taken on line 3—3 in FIG. 1A.
Figure 4:
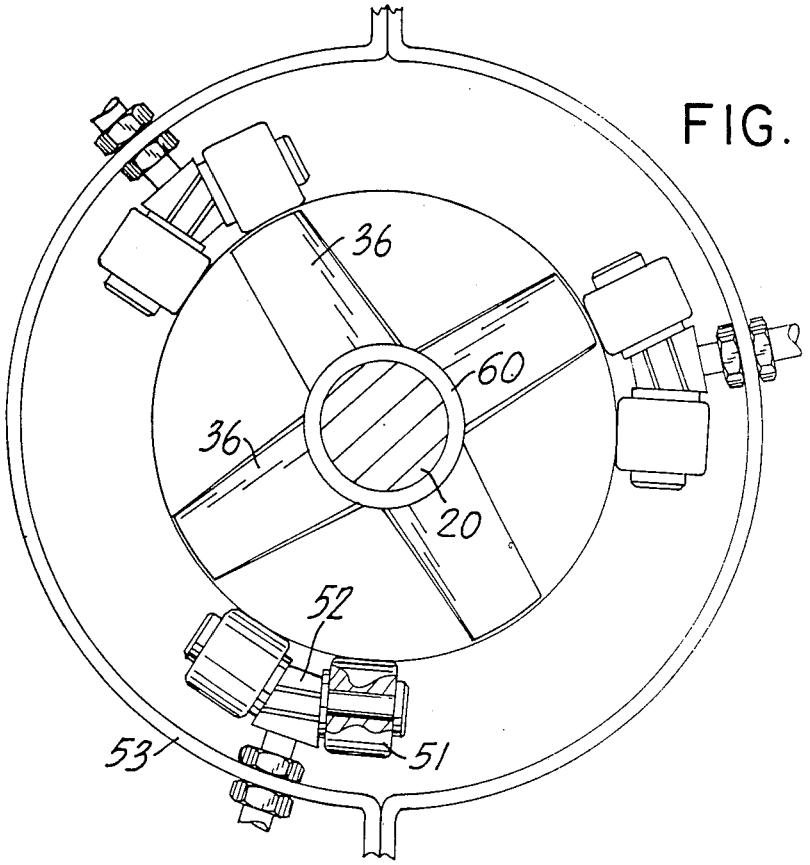
FIG. 4 is a sectional view taken on line 4—4 in FIG. 1B.

Referring to the drawing, next will be described a sanitary mixer, generally designated M in which solid particles, for example, in powder form are wetted by a liquid and the wetted particles are mixed to produce an agglomeration thereof. The agglomerates are discharged from the mixer and then dried, optionally after completion of a chemical reaction, to obtain a free flowing granular product.

If the liquid is supplied in greater amount, the end product discharged from the mixer will be a paste, slurry or solution depending upon the amount of liquid which is supplied.

The mixer M is specially constructed in order to produce pure products under sanitary conditions.

Although the mixer will be described hereafter for addition of a liquid to wet powder solids and mix the same, the mixer can also be utilized for producing a mixture of dry solids, for example, in powder form.

The mixer M comprises a frame 1 intended to be supported on a rigid, solid base or foundation. The frame 1 supports a mixing chamber 2 above which an inlet chamber 3 is supported in axial alignment. The mixing chamber 2 comprises a tubular wall 4 of flexible material, such as rubber. An upper edge portion 5 of the tubular wall is engaged in a recess 6 in a clamping ring 7 which is secured to the frame 1. The lower end of the tubular wall 4 has a conically flared skirt portion 8, which is clamped by a clamping ring 9 to the frame 1. Because the tubular wall is secured at its upper and lower edges, it can be placed under tension.

The inlet chamber 3 comprises an upper portion 10 and a lower portion 11 which are detachably connected together by bolts 12. The lower portion 11 is welded to the frame 1.

The upper portion 10 of the mixing chamber has two tubular inlets 13 arranged in diametric opposition to one another. The tubular inlets 13 are inclined upwardly and outwardly at an acute angle of about 45° with respect to a vertical axis x—x of the mixer. The tubular inlets 13 each serve for introduction of a solid, particulate material, for example, a powder into the mixing chamber 3. Each inlet 13 is capable of introducing a respective particulate material or mixture thereof, and the materials which are introduced into the two inlets may be different or the same. Although two inlets 13 are shown, it will be evident that a greater number can be employed on the upper inlet portion 10, preferably in a symmetrical annular arrangement around the vertical axis of the mixer. Furthermore, because the upper portion 10 is detachable from the lower inlet portion 11, a replacement inlet portion can be re-attached with a greater or lesser number of inlets 13.

The upper portion 10 is of generally dome-like configuration, which may be conical or spherical in shape, and it is provided with a flat upper wall 14 between the inlets 13.

The lower portion 11 of the inlet chamber comprises a conical wall 15 which tapers inwardly at substantially the same angle as the inlet portions 13 and which is joined to a cylindrical wall 16 whose lower end is welded to the frame 1 and is coaxial with tubular wall 4. A plurality of inlets 17 are incorporated in the tubular wall 16 for detachably receiving a liquid injector 18. The injector 18 projects downwardly into the interior of the mixing chamber 2. The liquid injector 18 faces downwardly and is adapted to inject liquid onto the solid particles which have been introduced into the inlet chamber 3 at the inlets 13 in order to wet the particles so that they will undergo mixing and agglomeration in the mixing chamber 2.

The arrangement of the conical chamber in portion 11 in axial continuation of the dome-like chamber in portion 10 thereabove is very effective in the smooth and controlled introduction of solids into the mixing chamber without turbulence which leads to the production of mixtures of solids which are homogeneous and uniform. There is virtually no dead space above the inlets 13 within the inlet chamber which results in high efficiency and mixing under controlled conditions whereby a uniform granulate product is discharged from the mixer.

A vertical mixing shaft 20 extends through the inlet chamber 3 into the mixing chamber 2 and carries blade assemblies 21, 22, and 23 for achieving mixing of the wet particles to obtain agglomeration thereof.

The shaft 20 exits through an opening 24 in the flat wall 14 of the inlet chamber and is supported outside the inlet chamber 3 in a bearing assembly 25 which is detachably connected by bolts 26 to an upward extension 27 of the upper portion 10 of the inlet chamber 3. The upward extension 27 is composed of a plurality of angular segments 28 which extend in spaced relation around the bearing assembly 25. Thereby, the external surfaces of the bearing assembly and the upper portion 10 of the inlet chamber are accessible for cleaning purposes.

A drive motor 29 is detachably connected by fasteners 30 to the bearing assembly 25 in axial alignment therewith.

A drive shaft 31 of the drive motor 29 is secured in a coupling 32, and the mixing shaft 20 is also secured in the coupling 32. In this way, there is a drive connection between the drive shaft 31 of the motor and the mixing shaft 20. The mixing shaft is supported by bearings 33 and 34 which are vertically spaced and provide for rotational support of the mixing shaft 20 in the bearing assembly 25. The bearings 33 and 34 are sealed bearings of permanent lubrication. Normally, the bearings 33 and 34 will be sufficient to support the weight and axial thrust of the shaft and the blades, however, if the load becomes too great, the coupling 32 can be supported by a thrust bearing 35, also sealed and of permanent lubrication.

Because the mixing shaft 20 is supported in bearings 33, 34 outside the inlet and mixing chambers, the latter chambers are isolated from any potential contamination by lubricant from the bearings. The mixing shaft 20 is effectively suspended from its drive means composed of the drive motor 29 and the bearing assembly 25 so as to be freely suspended within the inlet and mixing chambers. The mixing shaft 20 freely projects without any other support into the inlet and mixing chambers.

The bearing assembly 25 is interposed into a space defined above the flat wall 14 of the mixing chamber and within the confines of the inlets 13. This provides for a compact assembly and minimizes the overall length of the mixing shaft 20.

The mixing shaft 20 operates at relatively high speeds in order to achieve mixing of the solids and their wetting by the liquid. The agglomerated particles produce a substantial stress on the mixing shaft 20 due to their resistance and unbalance which is considerably greater than for liquid mixers which operate at relatively low speed. The stress which is produced on the mixing shaft of liquid mixers is relatively insignificant.

The blade assemblies 21, 22 and 23 have radially projecting blades 36 to achieve mixing of the wet particles to effect agglomeration thereof. The tips of the blades 36 are spaced from the inner surface of the flexible wall 4 by a distance of 5 to 10 mm. The mixing shaft 20 must rotate with accuracy on its vertical axis of rotation in order to maintain the clearance of the tips of the blades 36 with the flexible wall and prevent cutting of the wall by the blades 36. Because of the vertical suspension of the shaft freely in the inlet and mixing chambers and the support of the shaft outside the chambers by the vertically spaced bearings without further support, the shaft is made relatively rigid to assure its clearance with the flexible wall during high speed rotation. The operational rotation speed is between 1000 and 4000 rpm. It has been surprisingly found that the critical speed of the shaft at which it undergoes maximum deflection is below the operation speed of 1000 to 4000 rpm. This minimizes the wear on the bearings as the critical speed is only attained momentarily when the mixing shaft is being brought up to speed or is undergoing stoppage. In order to vary the speed of the shaft according to the mixing operation to be effected, the drive motor 29 is frequency controlled in order to permit continuous control of the mixing speed.

In order to seal the shaft 20 where it exits through the flat wall 14 at opening 24, a seal 37 is interposed between the bearing assembly 25 and the flat wall 14. The seal 37 comprises a pair of spaced rings 38 which support respective seal members 39 and 40 at upper and lower ends. The seal members 39 and 40 each abut against a respective ring 38. Seal 39 comprises a tubular lip 41 which engages the underside of the housing of the bearing assembly 25, while seal 40 has a tubular lip 42 which engages the upper surface of the wall 14. The distance between the rings 38 is adjustable so that the lips 41 and 42 resiliently abut against their respective bearing surfaces and also bear resiliently in sealing fashion against the outer surface of the mixing shaft 20. This construction of the seal 37 not only seals the wall 14 of the mixing chamber but also ensures that there will be no contamination of lubricant from the bearings into the inlet chamber 3.

Since the mixer is intended to achieve mixing of solids with other solids and/or liquids under sanitary conditions for the production of food, chemicals, minerals or pharmaceutical products of high purity, it becomes necessary to clean the interior of the mixer from time to time.

In order to effect so called "cleaning in place" of the mixer, a cleaning head 43 can be introduced into the inlets 13 for injecting a cleaning fluid under high pressure into the interior of the inlet chamber 3. The cleaning head 43 includes a spherical ejector with a number of holes therein for the discharge of the cleaning fluid. The cleaning head 43 can be pivoted and moved axially within the mixing chamber 3 in order to flush all regions thereof with the cleaning fluid. The smooth dome-shape of the interior of the upper portion 10 of the inlet chamber and the merged conical lower portion 11 of the inlet chamber insures that the cleaning fluid will thoroughly wash the interior of the inlet chamber and no re-entrant corners or crevices are formed in which residues could be retained.

In order to achieve more extensive cleaning of the interior of the inlet and mixing chambers, the construction makes it possible to remove the upper portion 10 of the mixing chamber, the bearing assembly 25, and the motor 29 as a unit from the lower portion 11 after detaching the bolts 12. When the unit is removed from the lower portion 11 of the inlet chamber, the mixing shaft 20 will be withdrawn therewith. In general, after the bolts 12 are detached, the entire unit is hoisted vertically so that the shaft 20 can be axially removed from the mixing chamber and the inlet chamber. When the unit has been removed, there will be access to the interior of the inlet chamber 3 and the mixing chamber 2.

In the event that there should be a breakage of any of the blades 36 of the blade assembly 21–23, or a fracture of the mixing shaft 20, the aforesaid unit can be quickly removed and replaced with another unit.

The aforesaid unit can also be removed when the products to be mixed in the mixer are to be changed. Removal of the unit enables the interior of the inlet and mixing chambers to be cleaned and the unit can be replaced by a clean unit. Consequently, there is little possibility of cross contamination of the different products in the successive mixing operations. The removed unit can be cleaned outside the mixer for future operations. It is of significance to note that the liquid injector 18 is removed before the unit is vertically hoisted out of place, and that the inlets 17 remain in place on wall 16 of the lower portion 11 of the mixing chamber 3 during the removal of the unit. In general, it is to be seen that the liquid inlets 17 do not interfere with the placement or removal of the upper portion 11 with its solids inlets 13.

In the assembled state, the liquid injector 18 is located relatively far below the inlets 13 so that there is little opportunity for the liquid to atomize and flow up above the solids where contamination could take place. Additionally, the dome-like shape of the upper portion 10 affords no space in which the liquid can build up.

In order to prevent accumulation of agglomerated material on the flexible wall 4, a deforming means 50 is mounted outside the wall 4 to continually deform the wall 4 during mixing. The deforming means 50 comprises a plurality of cylindrical rollers 51 which are arranged around the wall and bear against the external surface of the wall to deform the same. The rollers 51 are rotatably supported by tapered bars 52 secured to a cage 53 which undergoes intermittent movement in the form of vertical reciprocation concurrently with rotation of the mixing shaft 20. In order to achieve the vertical reciprocation of the cage 53, pneumatic cylinders 54 are arranged in diametric opposition on frame 1 and are connected by pivot joints 55 to rigid arms 56 connected to cylinders 57 which are slidable on fixed shafts 58 supported by frame 1. The pneumatic cylinders 54 undergo pulsed actuation as the shaft 20 rotates to cause the arms 56 to be shifted vertically and produce vertical reciprocation of cylinders 57 on shafts 58 which results in vertical reciprocation of the cage 53 and the rollers 51 on the tubular wall 4. This reciprocatory movement of the cage 53 causes the wall to undergo continual deformation under the bearing of the rollers 51 against the outer surface of the wall. Because the rollers 51 bear against the wall to deform the same, the wall undergoes slight vertical stretching as the cage reciprocates vertically. Because the wall is under tension due to its secured states at its upper and lower edges, the vertical stretching is slight. Although the pneumatic cylinders 54 and the shafts 58 have been shown fixed to the frame, it is possible to provide a rotatable support for the cage and to rotate the cage around the wall to produce the deformation thereof.

The blade blocks 21, 22 and 23 are fixed to a collar 60 which is secured to the mixing shaft 20. The blades 36 are welded to the respective blocks 21, 22 and 23. The blocks 21, 22 and 23 are detachably connected to the collar 60. The collar 60, in turn, is detachably connected to the shaft 20 by an end ring 61 which is welded to the collar and held in place on the shaft by a bolt 62 threaded into an end of the mixing shaft 20.

As previously noted, the flexible wall 4 is secured at its upper and lower ends and this minimizes surging of the product discharged at the lower end of the mixing chamber. In conventional equipment, the lower end of the flexible wall is unsecured and this leads to axial displacement of the flexible wall 4 which produces the surging at the outlet. The conical widening arrangement of the skirt 8 precludes build-up of material on the wall 4 and facilitates discharge by gravitational forces. Additionally, by mounting the lower end of the skirt 8 between the clamping ring 9 and the frame 1 a seal is formed at the outlet of the mixing chamber which prevents any intrusion of contaminants.

The mixer M can be operated as a continuous treatment mixer and it can periodically be cleaned routinely. When the mixer is to be changed over to produce a different product, the motor 29, bearing assembly 25, and upper portion 10 of the inlet chamber are removed as a unit together with the mixing shaft 20 and cleaned or replaced while the interior of the remaining inlet chamber and mixing chamber is cleaned. This changeover is relatively quick and minimizes down time of the mixer.

A number of features of the mixer M which satisfy the objects of the invention are noted particularly hereafter.

The frame 1 including the lower portion 11 of the inlet chamber is a one-piece unit of a welded construction.

No sharp corners are formed in the inlet and mixing chambers where product can be trapped.

The liquid injector 18 is connected in the mixer by a quick-release coupling at inlet 17.

The inlets 13 are inclined downwardly and inwardly towards axis x—x at substantially the same angle as the conical wall 15 of the lower portion 11 which in combination with flat wall 14 produces smooth inlet flow of powder solids with radial and downward velocity components without any dead space in the inlet chamber above the openings for the solids inlets 13 and no dead corners.

The bearing assembly 25 is disposed entirely outside the inlet and mixing chambers.

The bearings are sealed and permanently lubricated.

The shaft 20 is freely suspended in the inlet and mixing chambers and has an increased length compared to conventional mixers which makes it possible to position the liquid injector in the mixing chamber 2 well below the inlets 13. This enables the injection of liquid in a spray onto a curtain of falling powder which produces uniform wetting and mixing.

The shaft is directly driven by the motor 29.

The motor 29 can be regulated in its drive speed.

The blade blocks 21, 22, 23 are not separately mounted on the shaft 20 but are all mounted on the common collar or sleeve 60.

The blades 36 are welded to the blade blocks 21–23 or collar 60.

The wall 4 is secured at its opposite ends.

The rollers 51 are mounted by the tapered bars 52 on cage 53 in a distributed array around the wall 4.

This leads to less vertical stretching of the wall 4 and minimal surging of the discharged product whereby the product is homogeneous, and more uniformly agglomerated.

Although the invention has been described in relation to a specific embodiment thereof, it will become apparent to those skilled in the art that numerous modifications and variations can be made within the scope and spirit of the invention as defined in the attached claims.

What is claimed is:

1. A mixer for mixing substances under sanitary conditions comprising a mixing chamber, a rotatable mixing shaft in said mixing chamber, said shaft extending vertically, blade means on said mixing shaft for mixing a product in said mixing chamber, an inlet chamber secured to said mixing chamber and including first inlet means for introducing solid particles into the inlet chamber, second inlet means for combining a second substance with the solid particles which have been introduced in the mixing chamber, said mixing shaft extending vertically outside and above said inlet chamber, a bearing assembly secured outside and above said inlet chamber and including first and second bearings located one above the other rotatably supporting said shaft, said shaft extending downwardly in suspended manner from said bearing assembly and freely projecting without any other support into the inlet and mixing chambers, and seal means for sealing said shaft and said inlet chamber, said mixing chamber comprising a tubular wall of flexible material surrounding said blade means, and means for deforming said wall as said mixing shaft rotates to prevent accumulation of mixed material on said wall, said wall having a bottom outlet for discharge of mixed material.

2. A mixer as claimed in claim 1 wherein said second inlet means comprises a liquid injector, the second substance being a liquid.

3. A mixer as claimed in claim 2 wherein said liquid injector is positioned to inject the liquid into said mixing chamber.

4. A mixer as claimed in claim 3 wherein said liquid injector is disposed in said mixing chamber above said blade means.

5. A mixer as claimed in claim 1 comprising a thrust bearing for said shaft in said bearing assembly.

6. A mixer as claimed in claim 1 wherein said tubular wall has upper and lower ends which are fixedly secured, said bottom outlet being at said lower end.

7. A mixer as claimed in claim 6 wherein said lower end of the tubular wall tapers in conically widening fashion and terminates at said bottom outlet.

8. A mixer as claimed in claim 1 wherein said inlet chamber comprises upper and lower portions, the lower portion being secured to the mixing chamber, said first inlet means being in said upper portion.

9. A mixer as claimed in claim 8 wherein said lower portion has a conically flared head section and a tubular base section coincident with said mixing chamber.

10. A mixer as claimed in claim 9 wherein said first inlet means comprises at least two inlet portions extending at an angle to the vertical shaft.

11. A mixer as claimed in claim 10 wherein said angle is an acute angle.

12. A mixer as claimed in claim 10 wherein the angle of the inlet portions relative to the vertical shaft is the same as the angle of the conically flared head section of the lower portion relative thereto.

13. A mixer as claimed in claim 8 wherein said second inlet means has an inlet disposed in said lower portion of the inlet chamber.

14. A mixer as claimed in claim 8 comprising means securing said bearing assembly to said upper portion of the inlet chamber in fixed relation thereto, and means detachably connecting the upper and lower portions of the inlet chamber so that the bearing assembly, the upper portion of the inlet chamber and said mixing shaft can be removed as a unit from the lower portion of the inlet chamber and said mixing chamber and provide access to the interior of the inlet chamber and the mixing chamber.

15. A mixer as claimed in claim 14 comprising drive means disposed above the bearing assembly for driving said mixing shaft, said drive means being secured to said bearing assembly for removal with said unit.

16. A mixer as claimed in claim 1 comprising drive means disposed above the bearing assembly and coaxially arranged in driving relation with said shaft.

17. A mixer as claimed in claim 16 wherein said drive means is frequency controlled for continously controlling the mixing.

18. A mixer as claimed in claim 16 wherein said drive means is secured to said bearing assembly as a unit.

19. A mixer as claimed in claim 1 comprising means securing the bearing assembly to the inlet chamber in fixed relation thereto.

20. A mixer as claimed in claim 1 wherein said means for deforming said wall as said shaft rotates comprises cylindrical rollers engaging said tubular wall on the outer surface thereof and disposed around said wall to deform the same.

21. A mixer as claimed in claim 1 wherein said means for deforming said wall as said shaft rotates comprises cylindrical members bearing against said wall and rotatable thereon.

22. A mixer as claimed in claim 1 wherein said means for deforming said wall as said shaft rotates comprises bars.

23. A mixer as claimed in claim 1 wherein said means for deforming said wall as said shaft rotates comprises deforming members bearing against said wall and means for intermittently moving said deforming members.

24. A mixer as claimed in claim 1 wherein said means for deforming said wall as said shaft rotates comprises means for vertically stretching said wall intermittently as the shaft rotates.

25. A mixer as claimed in claim 1 wherein said means for deforming said wall is rotatable around said wall as said shaft rotates.

26. A mixer as claimed in claim 1 wherein said blade means comprises a plurality of blade blocks on said shaft superposed above one another, and blades being secured to said blade blocks.

27. A mixer as claimed in claim 26 wherein said blades are welded to said blade blocks.

28. A mixer as claimed in claim 26 wherein said blade means further comprises a removable sleeve secured to said shaft, said blade blocks being secured to said sleeve.

29. A method of mixing two substances to produce a mixed product under sanitary conditions, said method comprising supplying a solid particulate substance into an inlet chamber with radial and downward velocity components, mixing a second substance with the particulate substance in a mixing chamber below the inlet chamber by rotating a vertical shaft with mixing blades thereon in said mixing chamber, deforming the mixing chamber as the shaft rotates to prevent accumulation of mixed product in the mixing chamber, rotatably supporting the vertical shaft by bearings outside the inlet and mixing chambers so as not to contaminate the substances whereby mixing takes place under sanitary conditions and discharging the mixture of substances from below the mixing chamber.

30. A method as claimed in claim 29 comprising suspending the vertical shaft from the bearings outside the inlet and mixing chambers and sealing the shaft where the shaft enters the inlet chamber.

31. A method as claimed in claim 29 wherein said second substance is a solid.

32. A method as claimed in claim 29 wherein said second substance is a liquid, said liquid being injected onto the powder substance as the powder substance travels downwardly.

33. A method as claimed in claim 29 comprising removing as a unit from said mixing chamber, said shaft, said bearings and a portion of said inlet chamber and replacing said unit with a cleaned unit.

34. A method as claimed in claim 33 wherein said unit is removed from the mixing chamber by vertically hoisting the unit out of the mixing chamber.

* * * * *